US005728236A

United States Patent [19]

Rundhaug

[11] Patent Number: 5,728,236

[45] Date of Patent: Mar. 17, 1998

[54] PROCESS FOR PRODUCING AN ORNAMENTAL RUST FINISH ON A FERROUS METAL SURFACE

[75] Inventor: Patrick A. Rundhaug, Tucson, Ariz.

[73] Assignee: Chem-Pro, Tucson, Ariz.

[21] Appl. No.: 547,227

[22] Filed: Oct. 24, 1995

[51] Int. Cl.[6] ..... C23C 22/50

[52] U.S. Cl. ..... 148/270; 148/273

[58] Field of Search ..... 148/269, 270, 148/273, 271

[56] References Cited

U.S. PATENT DOCUMENTS

| | | | |
|---|---|---|---|
| 2,001,753 | 5/1935 | Tanner | 148/269 |
| 2,054,737 | 9/1936 | Brunner | 148/269 |
| 3,725,138 | 4/1973 | Jones | 148/269 |
| 3,930,898 | 1/1976 | Cooley | 148/270 |
| 5,160,381 | 11/1992 | Gervias | 148/269 |

OTHER PUBLICATIONS

Metal Coloring, David Fishlock pp. 240–241 1962.

*Primary Examiner*—Sam Silverberg
*Attorney, Agent, or Firm*—Jerome M. Teplitz

[57] ABSTRACT

A chemically derived product that rusts metal instantly upon contacting the surface of a metal and which can be easily and safely used by ornamental metal craftpersons. The chemically derived product is a liquid compound that contains the following constituents: (a) 93.0% by weight of water; (b) up to 5.0% by weight of a copper salt, the copper salt being selected from a copper salt group consisting of copper sulfate, copper nitrate, and copper chloride; and (c) a remaining amount consisting of an acid compound selected from an acid compound group consisting of sulfamic acid, oxalic acid, hydrochloric acid and nitric acid. The liquid compound can be particularly formulated for oxidizing steel or copper and may be produced having a predetermined coloring dye constituent selected from a color dye group consisting of copper, auburn, or gold, if oxidizing steel, or a color dye selected from a color dye group consisting of patina, aqua blue, or green, if oxidizing copper.

5 Claims, No Drawings

PROCESS FOR PRODUCING AN ORNAMENTAL RUST FINISH ON A FERROUS METAL SURFACE

FIELD OF THE INVENTION

The present invention relates to oxidation/rusting of metals. More particularly, the present invention relates to chemical products that promote oxidation/rusting of metals. Even more particularly, the present invention relates to chemical products that promote oxidation/rusting of metals and that facilitate methods of producing a rusty finish on ornamental metal works.

DESCRIPTION OF THE PRIOR ART

Rust is traditionally known as a reddish brittle coating formed on iron when chemically attacked by moist air and is composed primarily of ferric oxide. A comparable coating can be formed on metal other than iron by corrosion. In chemical terms, rust is a form of oxidation, and oxidation in turn is the state or result of combining with oxygen. The corrosive coatings are oxides of the metals. Traditionally, the rusting process is environmentally related and is very much associated with exposure of a metal element to the environment over a long period of time. Metals that have been rusted have had an appeal in the decorating industry, especially for decorative products that are created to resemble the Old West rustic period. Such products include lettering for gates and wild animal silhouettes, such as coyotes and javalina.

Known prior art methods of producing, or encouraging the rusting process include soaking the metal with acid, soaking in salt-water and laying the metal, typically steel, outside waiting for rain. While the latter my produce true rust, environmentally contaminated rain may produce other undesirable residues on the exposed metal surfaces. These processes do not produce true oxidation of metallic substances, instead, these processes bond the valence electron of the metal to an anion of a salt such as chloride or sulfate. This creates an artificial rust such a iron chloride (ferrous chloride) or iron sulfate instead of iron oxide (ferric oxide) which is true rust. The prior art method of producing artificial rust has problems which are drawbacks for continuing their practice. For example, these artificial products do not have the appearance as true rust, and hence do not produce the desired aesthetic results, i.e. discoloration of the finish very often results. Further, the artificially created rust (salt) is easily washed away by heavy rains, i.e. the salts are soluble in water. In contrast, real rust continues the rusting process during heavy rains since $H_2O$ bombards the surface with additional oxygen molecules. Artificial rust is created at the time of the reaction but does not continue when exposed to the environment. Since most decorative iron work applications need a steady supply of material, and since passage of time to naturally produce rust is not a plausible option, the metal craftsman has had to produce the decorative metal finish using the artificial products.

Thus, a need is seen to exist for an economics/compound that will produce a true rust coating upon contacting a metal.

It is therefore an object of the present invention to provide an economical compound that will instantly produce a true rust coating upon contacting a metal, by example, upon contacting steel, iron, copper, magnesium, lead, silver, beryllium, selenium, cobalt and antimony.

Another object of the present invention is to provide a method of creating a true rust finish on decorative metal works.

A related object of the present invention is to provide a method for creating a true rust finish having a predetermined color on decorative metal works.

SUMMARY OF THE INVENTION

Accordingly, the foregoing objects are accomplished by providing a chemically derived product that rusts metal instantly upon contacting the surface of a metal and which can be easily and safely used by ornamental metal craftpersons. The chemically derived product is a liquid compound that contains the following constituents: (a) 93.0% by weight of water; (b) up to 5.0% by weight of a copper salt, the copper salt being selected from a copper salt group consisting of copper sulfate, copper nitrate, and copper chloride; and (c) a remaining amount consisting of an acid compound selected from an acid compound group consisting of, but not limited to, sulfamic acid, oxalic acid, hydrochloric acid and nitric acid. By example, the liquid compound can be particularly formulated for oxidizing steel or copper. If the application requires oxidizing a metal member selected from a sub-metal group consisting of steel, iron, magnesium, or lead, the liquid compound may be applied as produced to yield a copper-like color finish. If other color finishes are desired for oxidizing this particular sub-metal group, the liquid compound may be further processed having a predetermined coloring dye constituent selected from a color dye group consisting of auburn, or gold dyes. Alternatively, if the application requires oxidizing copper, the liquid compound may be produced having a predetermined coloring dye constituent selected from a color dye selected from a color dye group consisting of patina, aqua blue, or green dyes.

Therefore, to the accomplishments of the foregoing objects, the invention consists of the foregoing features hereinafter fully described and particularly pointed out in the claims, the following disclosure describing in detail the invention, such disclosure describing but one of the various ways in which the invention may be practiced.

DESCRIPTION OF THE INVENTION

The rust producing livid compound comprises: (a) 93.0% by weight of water; (b) up to 5.0% by weight of a copper salt, the copper salt being selected from a copper salt group consisting of copper sulfate, copper nitrate, and copper chloride; and (c) a remaining amount consisting of an acid compound selected from an acid compound group consisting of, but not limited to, sulfamic acid, oxalic acid, hydrochloric acid and nitric acid. The remaining amount can be a combination acid compound selected from a combination of the members of the acid compound group.

If the end use of the rust producing liquid compound is for use on a steel ornamental piece, the liquid compound can be produced by the steps of: (a) providing 55 gallons of water in a container; (b) admixing 25 lbs of a copper salt with the water, the copper salt being selected from a copper salt group consisting of copper sulfate, copper nitrate, and copper chloride; and (c) further admixing 10 lbs of dry sulfamic acid to the compound produced in steps (a) and (b). The resulting liquid compound has a natural copper-like color and may be used directly to produce a copper-like finish. If other color finishes are desired, the compound can be colored, by example, with a coloring dye constituent selected from a color dye group consisting of auburn, or gold dyes.

If the end use of the rust producing liquid compound is for use on a copper ornamental piece, the liquid compound can be produced by the steps of: (a) providing 55 gallons of water in a container; (b) admixing 5 to 25 lbs of a copper salt with the water, the copper salt being selected from a copper salt group consisting of copper sulfate, copper nitrate, and copper chloride; and (c) further admixing an acid compound having a strength of 5% to 75% in solution with the acid compound produced in steps (a) and (b). The liquid compound can be further processed to include a predetermined coloring dye constituent selected from a color dye group consisting of patina, aqua blue, or green dyes.

In use, the process for oxidizing a metal and producing an ornamental finish on the metal comprises the steps of:

(a) providing a rust producing liquid compound, said compound comprising:
  (i) 93.0% by weight of water;
  (ii) up to 5.0% by weight of a copper salt, said copper salt being selected from a copper salt group consisting of copper sulfate, copper nitrate, and copper chloride; and
  (iii) a remaining amount consisting of an acid compound selected from an acid compound group consisting of, but not limited to, sulfamic acid, oxalic acid, hydrochloric acid and nitric acid;

(b) providing a metal member selected from a metal group consisting of steel, iron, copper, magnesium, lead, silver, beryllium, selenium, cobalt and antimony, said metal member having a surface area requiring an oxidized Coating to show as an ornamental finish;

(c) spraying a mist of said compound onto, and throughout, said surface area and contacting said surface area;
  (d) oxidizing said surface area upon said mist of said compound contacting said surface area; and
  (e) repeating said steps (c) and (d) as required to obtain a desired amount of said compound on said surface area to create said ornamental finish.

EXAMPLE 1

A rust producing liquid compound for oxidizing steel was prepared by (a) providing 55 gallons of water in a container; (b) admixing 10 lbs of copper sulfate with the 55 gallons of water; and (c) further admixing 25lbs of sulfamic acid to the compound produced in steps (a) and (b). A portion of the liquid compound was dispensed into a one (1) gallon container and further processed by mixing the liquid compound with a gold coloring dye constituent. The remaining amount of the liquid compound was stored for future dispensing into one (1) gallon containers and mixing with a predetermined coloring dye constituent selected from a color dye group consisting of auburn, or gold. The end use of the 1 gallon container of the copper colored liquid compound was for use by a craftsman for producing a natural rust color on any of the surfaces of sheet metal, angle iron, iron rods or tubular steel members.

EXAMPLE 2

A rust producing liquid compound for oxidizing steel was prepared by (a) providing 55 gallons of water in a container; (b) admixing 10 lbs of copper sulfate with the 55 gallons of water; and (c) further admixing 2000 ML of 50% solution of hydrochloric acid to the compound produced in steps (a) and (b). A portion of the liquid compound was dispensed into a one (1) gallon container and further processed by mixing the liquid compound with a patina coloring dye constituent. The remaining amount of the liquid compound was stored for future dispensing into one (1) gallon containers and mixing with a predetermined coloring dye constituent selected from a color dye group consisting of patina, aqua blue, or green. The end use of the 1 gallon container of the patina colored liquid compound was for use by a craftsman for producing a natural rust color on any of the surfaces of copper sheets, copper fixtures, copper pipes, or other copper metal members.

EXAMPLE 3

A one (1) gallon container of the insta-rust producing liquid compound produced in Example 1 was provided for use by a metal craftsperson for creating an oxidized copper finish on a wrought iron metal gate. One quart of the copper colored liquid compound was poured into a one quart container having a mist spray nozzle. The metal craftsperson sprayed the compound onto the entire surface of the wrought iron metal gate. Within thirty (30) seconds, the applied coating of the liquid compound reacted with the iron metal members and produced a copper colored layer of rust. The first coat was allowed to set for five (5) minutes after which a second coat of the liquid compound was sprayed onto the entire surface of the wrought iron metal gate. The second coat further reacted with the wrought iron to produce an enhanced layer of rust. A protective layer of an acrylic polymer sealer was applied throughout the entire surface of the wrought iron gate to preserve the ornamental finish and prevent further rusting by exposure to the outdoor environment.

Therefore, while the present invention has been described herein in what is believed to be the most practical and preferred formulations, it is recognized that departures can be made therefrom within the scope of the invention, which is therefore not to be limited to the details disclosed therein but is to be accorded the full scope of the claims so as to embrace any and all equivalent compounds.

I claim:

1. A process for producing an ornamental rust finish on a ferrous metal surface, comprising the steps of:

(a) applying to said ferrous metal surface an aqueous solution having ferric oxide-forming oxidizing reactivity with said ferrous metal surface, said aqueous solution comprising a copper salt and an acid in relative concentrations effective for imparting said oxidizing reactivity to said aqueous solution, said copper salt being selected from the group consisting of copper sulfate, copper nitrate and copper chloride said acid being selected from the group consisting of sulfamic acid and oxalic acid; and (b) oxidizing said ferrous metal surface with said aqueous solution so as to form said rust finish as an oxidation reaction product composed primarily of ferric oxide.

2. The process of claim 1, wherein said aqueous solution comprises up to 5.0% by weight of said copper salt and at least 1.0% by weight of said acid.

3. The process of claim 2, wherein said copper salt is cooper sulfate and said acid is sulfamic acid.

4. The process of claim 1, wherein said aqueous solution further comprises a coloring dye selected from a color dye group consisting of copper, auburn and gold.

5. The process of claim 1, whereto said aqueous solution is applied to said ferrous metal surface by spraying a mist of said aqueous solution onto said ferrous metal surface.

* * * * *